284812 0194 --00 02-19-91 45128 01-18-91 151419 78147.0 04993252 0617

United States Patent [19]

Scanlon et al.

[11] Patent Number: 4,993,252

[45] Date of Patent: Feb. 19, 1991

[54] EXTRUSION PULLER JAWS

[75] Inventors: Robert M. Scanlon, Sand Lake; Gregory A. Berrevoets, Greenville, both of Mich.

[73] Assignee: Granco-Clark, Inc., Belding, Mich.

[21] Appl. No.: 502,347

[22] Filed: Mar. 30, 1990

[51] Int. Cl.[5] ..... B21C 35/02

[52] U.S. Cl. ..... 72/257; 72/422

[58] Field of Search ..... 72/257, 422; 24/DIG. 22

[56] References Cited

U.S. PATENT DOCUMENTS

| | | |
|---|---|---|
| 3,078,984 | 2/1963 | Baker . |
| 3,118,539 | 1/1964 | Harwood . |
| 3,230,753 | 1/1966 | Walker . |
| 3,587,280 | 6/1971 | Engelhardt . |
| 3,881,339 | 5/1975 | Mannell . |
| 4,307,597 | 12/1981 | Elhaus . |
| 4,522,091 | 6/1985 | Toffolon . |
| 4,566,298 | 1/1986 | Elhaus . |

OTHER PUBLICATIONS

Smith Design, Exhibit A, prior to Mar. 30, 1990.

*Primary Examiner*—Lowell A. Larson

*Attorney, Agent, or Firm*—Varnum, Riddering, Schmidt & Howlett

[57] ABSTRACT

An extrusion puller which comprises an upper jaw, a lower jaw, and means for mounting the upper and lower jaw relative to each other. The upper jaw comprises a plurality of jaw fingers with radially extending gripping teeth circumferentially spaced around the bottom portion of the tooth wherein the attack angle between teeth and the spacing angle between adjacent teeth is selected so that substantially full penetration of at least one of the gripping teeth into the workpiece is achieved without interference from an adjacent tooth. The lower jaw comprises a serrated upper surface comprising a semi-circular scalloped configuration of a plurality of peaks and valleys. The combination of the upper jaw and lower jaw configuration allows for increased gripping strength to be exerted on the workpiece and thereby avoid defects within the extruded workpiece.

16 Claims, 8 Drawing Sheets

EXTRUSION PULLER JAWS

TECHNICAL FIELD

The invention relates to extrusion puller apparatus and, more, particularly, to the extrusion puller jaws which grip the workpiece during an extrusion operation.

BACKGROUND OF THE INVENTION

One known extrusion pulling apparatus incorporates extrusion puller jaws composed of an upper and lower jaw wherein the upper jaw comprises a plurality of multi-toothed fingers and the lower jaw comprises a flat serrated plate. One jaw moves relative to the other to allow for opening and closing movement of the jaws for gripping and releasing of an extruded workpiece. Typically, the upper jaw moves relative to a fixed lower jaw and a sufficient amount of gripping pressure is applied to the workpiece by the jaws so that the extrusion apparatus can pull the workpiece from the die.

FIG. 1 (prior art) and FIG. 1A (prior art) (hereinafter known as the "Smith Design") illustrate a known upper jaw finger 10A and a lower jaw 12A in an extrusion puller apparatus for gripping an extruded workpiece 14A. The upper jaw finger is comprised of a body 16A, means for mounting the finger 18A into the upper jaw and a plurality of gripping teeth 20A. Each of the teeth is comprised of a leading edge 22A and a trailing edge 24A. The angle created between the leading edge 22A of one tooth and the trailing edge 24A of the preceding tooth is the attack angle A.

The upper jaw typically is pivotably mounted relative to the fixed lower jaw 12A. The upper jaw pivots downward until the teeth of both jaws engage the workpiece 14A and applies force thereto to create sufficient gripping pressure on the extruded workpiece 14A. The pivotable movement of the upper jaw causes the teeth 20A to travel along an arc B during the gripping and releasing movement of the jaws. The teeth 20A of the jaw finger 10A may contact the workpiece 14A anywhere along arc B depending on the profile of the workpiece 14A.

Because of the large number of teeth 20A on each upper jaw finger 10A of the Smith Design, the attack angle A on the Smith Design is relatively small. Therefore as the upper jaw finger 10A pivots downward the teeth travel along arc B until a first tooth 23A enters the workpiece 14A. But, before all of the body of the first tooth 23A penetrates the workpiece 14A, the flat trailing edge 24A of the preceding tooth 25A contacts the workpiece 14A. The flat trailing edge 24A of the preceding tooth 25A cannot penetrate the surface of the workpiece 14A without a great amount of pressure from the upper jaw. Without this extremely large force, the gripping strength of the jaws may be inadequate and often results in slippage of the workpiece 14A within the jaws.

The lower jaw 12A of the Smith design comprises a plurality of serrations 26A which extend perpendicular to the extrusion axis and are spaced a short distance apart. The serrations 26A are composed of a plurality of peaks 28A and valleys 30A or may be a saw tooth design (not shown). The Smith design utilizes a plurality of small serrations as shown in FIG. 1 (Prior Art).

The U.S. Pat. No. 4,566,298 to Elhaus (issued Jan. 28, 1986) discloses an extrusion puller incorporating a plurality of clamping segments or puller fingers. This concept is also disclosed in the U.S. Pat. No. 3,188,539 to Harwood et al (issued Jan. 21, 1964), the U.S. Pat. No. 4,307,597 to Elhaus et al (issued Dec. 29, 1981) and the U.S. Pat. No. 3,881,339 to Mannell (issued May 6, 1975).

The Mannell patent also discloses the concept of providing springs or other biasing means to each of the individual fingers to allow for the gripping of a complex-shaped workpiece.

The concept of incorporating a plurality of serrated jaws for gripping a workpiece during extrusion is disclosed in the U.S. Pat. No. 4,522,091 to Toffolon (issued June 11, 1985) and the U.S. Pat. No. 3,078,984 to Baker (issued Feb. 26, 1963).

SUMMARY OF THE INVENTION

According to the invention, an extrusion puller has an upper jaw, a lower jaw, and mounting means. The upper jaw comprises a plurality of fingers with radially extending gripping teeth, the teeth are circumferentially spaced about the bottom portion for penetrating a workpiece. The lower jaw comprises a serrated upper face for gripping and the mounting means for the upper and lower jaws are adapted for reciprocal movement with respect to each other to alternatively grip and release the extruded workpieces. The teeth on the upper jaw fingers have an attack angle and a spacing angle between adjacent teeth selected so that substantially full penetration of at least one of the gripping teeth into the workpiece can be achieved without interference from an adjacent tooth.

A preferred embodiment of the jaw finger has at least two teeth and semi-circular scalloped indentations on the lower jaw upper face for increased gripping strength by the lower jaw. Typically, the upper and lower jaws are mounted for pivotable movement with respect to each other.

The attack angle between the leading edge of one tooth and trailing edge of an adjacent tooth must be great enough to allow for the full penetration of at least one tooth of the upper jaw finger. Therefore, the attack angle must at least be 80° and preferably about 83°. In addition, the spacing angle sufficient to allow substantially full penetration of at least one tooth into the workpiece will generally exceed 30°, preferably about 40°. The preferred embodiment incorporates three teeth on the end of each of the plurality of upper jaw fingers to create an upper jaw which may adequately grip the extruded workpiece and avoid slippage.

The lower jaw semi-circular scalloped indentations have a spacing between serrations generally between 0.125 and 0.625, preferably about 0.38 inches. The lower jaw is mounted from one end so that the serrated upper face is cantilevered and at an upper acute angle to the horizontal. This orientation compensates for the downward force exerted on the lower jaw by the upper jaw during the gripping operation. When this force is exerted, the lower jaw flexes so that the lower jaw is horizontal and warpage and bending of the extruded workpiece can be minimized.

The combination of the upper jaw and lower jaw configuration of the invention allows for increased gripping strength over designs heretofore known. The invention eliminates interference between adjacent teeth on each upper jaw finger, thereby allowing the full body of at least one tooth to penetrate the workpiece. This increased gripping strength allows for faster, more versatile extrusions in addition to eliminating defects in the extruded workpiece caused by slippage within the jaws.

BRIEF DESCRIPTION OF DRAWINGS

The invention will now be described in detail with reference to the accompanying drawings wherein.

DESCRIPTION OF THE PREFERRED EMBODIMENT

Figure 1:
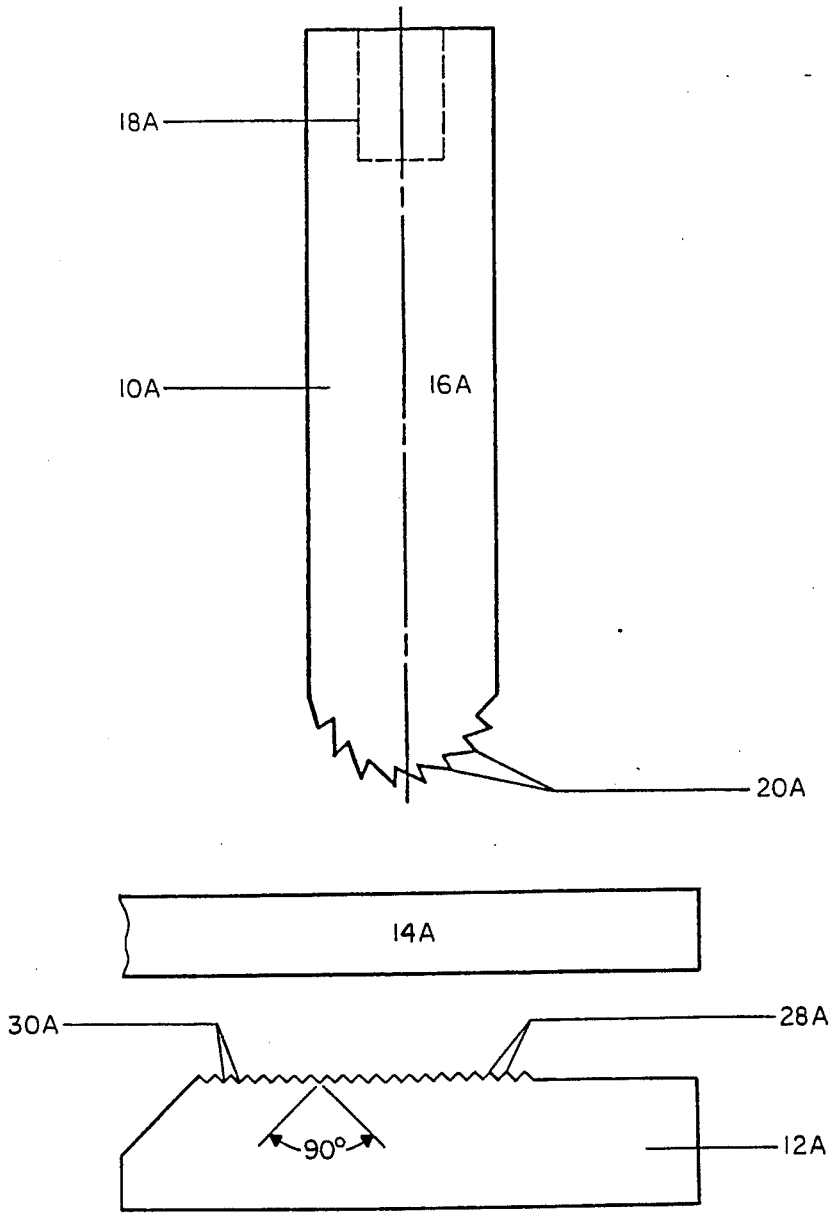
FIG. 1 (PRIOR ART)
FIG. 1 (Prior Art) is an exploded elevational view of an upper and lower jaw known heretofore.
Figure 1A:
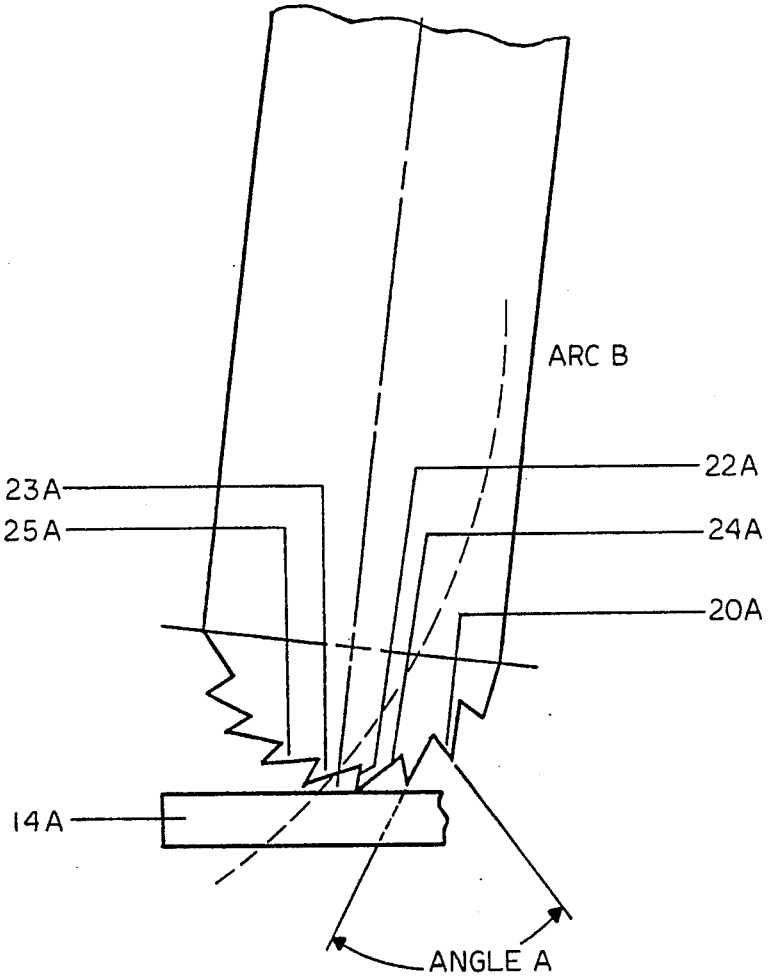
FIG. 1A (PRIOR ART)
FIG. 1*a* (Prior Art) is an enlarged partial elevational view of an upper jaw finger shown in FIG. 1.
Figure 2:
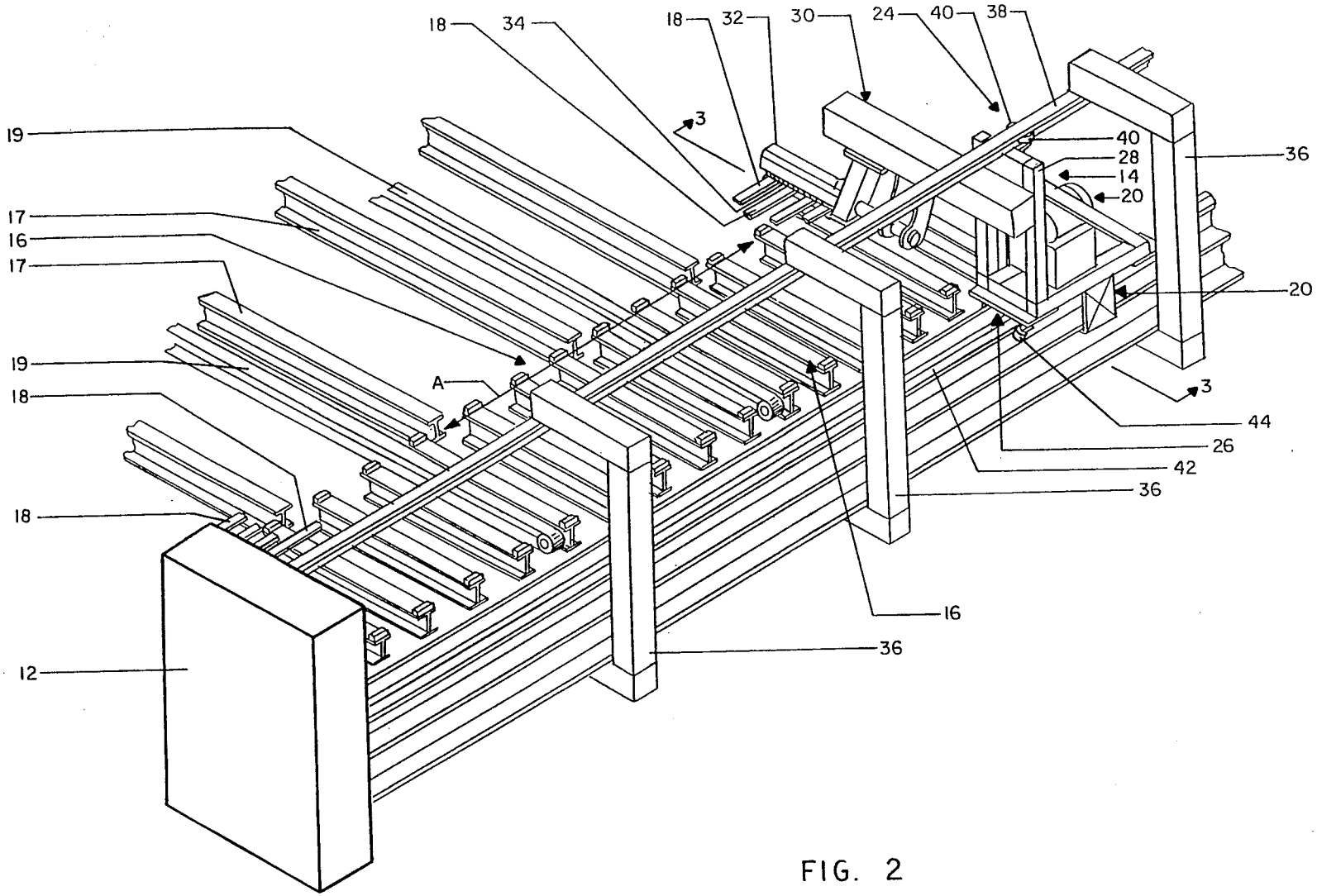
FIG. 2 is a perspective view of an extrusion pulling apparatus employing gripper jaws according to the invention.

Referring to FIG. 2, an extrusion puller 14 is mounted on a lower guide means 26 and an upper guide mean 24 for movement along a run-out table 16 from an extrusion press 12. It is well known to construct a pulling apparatus wherein a material to be pulled 18 is forced through the extrusion press 12 and gripped by the extrusion puller 14. The extrusion puller 14 is driven away from the extrusion press 12 along an extrusion axis A by a suitable drive means which may include a chain (not shown) beneath the run-out table 16 and a chain connector 20. After the extrusion is completed, the extruded material 18 is moved to a cooling table 17 by a belt conveyor 19 for further processing.

Figure 3:
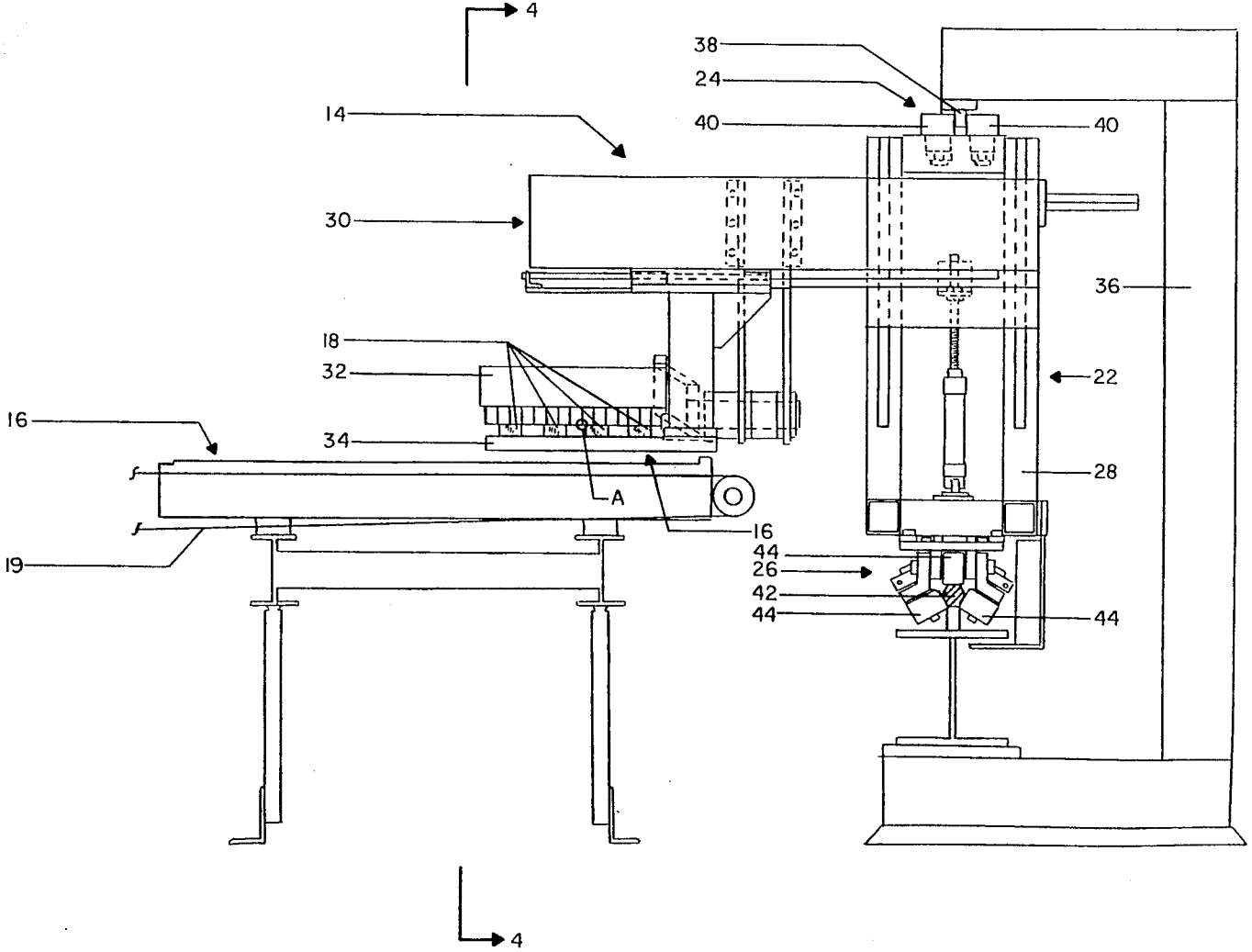
FIG. 3 is a partial sectional view along lines 3—3 of FIG. 2.

As seen in FIG. 3, the extrusion puller 14 is guided along the pulling axis A by an extrusion puller mounting 22. The extrusion puller mounting 22 is guided by the upper guide means 24 and lower guide means 26. These guide means help to provide support and linear accuracy in the extrusion process.

The extrusion puller mounting 22 comprises a rectangular support frame 28 which is mounted between the upper guide means 24 and the lower guide means 26. Fixedly attached to the rectangular frame 28 is a suitable mounting structure 30 for a pair of extrusion puller jaws, an upper jaw 32 and a lower jaw 34. The puller jaw mounting structure 30 is arranged such that the puller jaws 32, 34 are above and adjacent to the run-out table 16. On the opposite side of the rectangular frame 28 from the mounting structure 30 and puller jaws 32, 34 is a C-shaped support frame 36. The C-shaped support frame 36 provides support for the rectangular support frame 28 in conjunction with the upper and lower guide means 24, 26.

The upper and lower guide means 24 and 26 may appear in numerous different embodiments, one of which the upper guide means comprises a T-shaped beam 38 and a pair of rollers 40 and the lower guide means 26 comprises a hexagonal beam 42 and a plurality of rollers 44.

Figure 4:
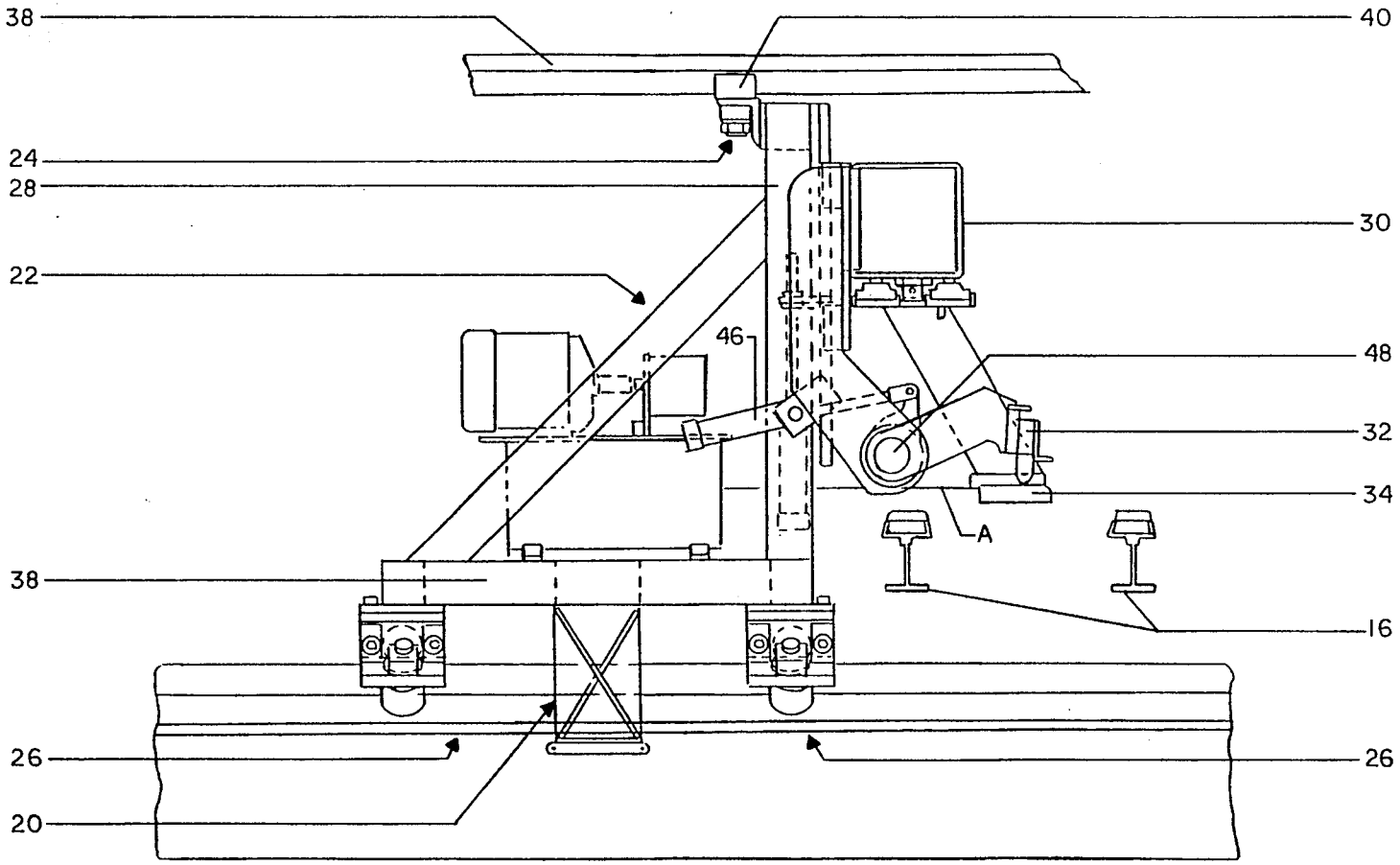
FIG. 4 is a partial side view of the extrusion puller mounting along lines 4—4 of the FIG. 3.

As seen in FIG. 4, the upper jaw 32 is mounted above and in close proximity to the lower jaw 34. The upper jaw is pivotally mounted to the mounting structure 30 through suitable means 46 for reciprocable movement about pivot point 48. The lower jaw 34 is fixedly attached to the mounting structure 30 and stationary relative to the upper jaw 32. The pivot means 46 are conventional in nature and are suitable for rotating the upper jaw 32 with respect to the lower jaw 34. The vertical movement of the upper jaw 32 with respect to the lower jaw 34 by the pivot means 46 allows for the creation of the proper gripping pressure by the jaws, 32 and 34.

Figure 5:
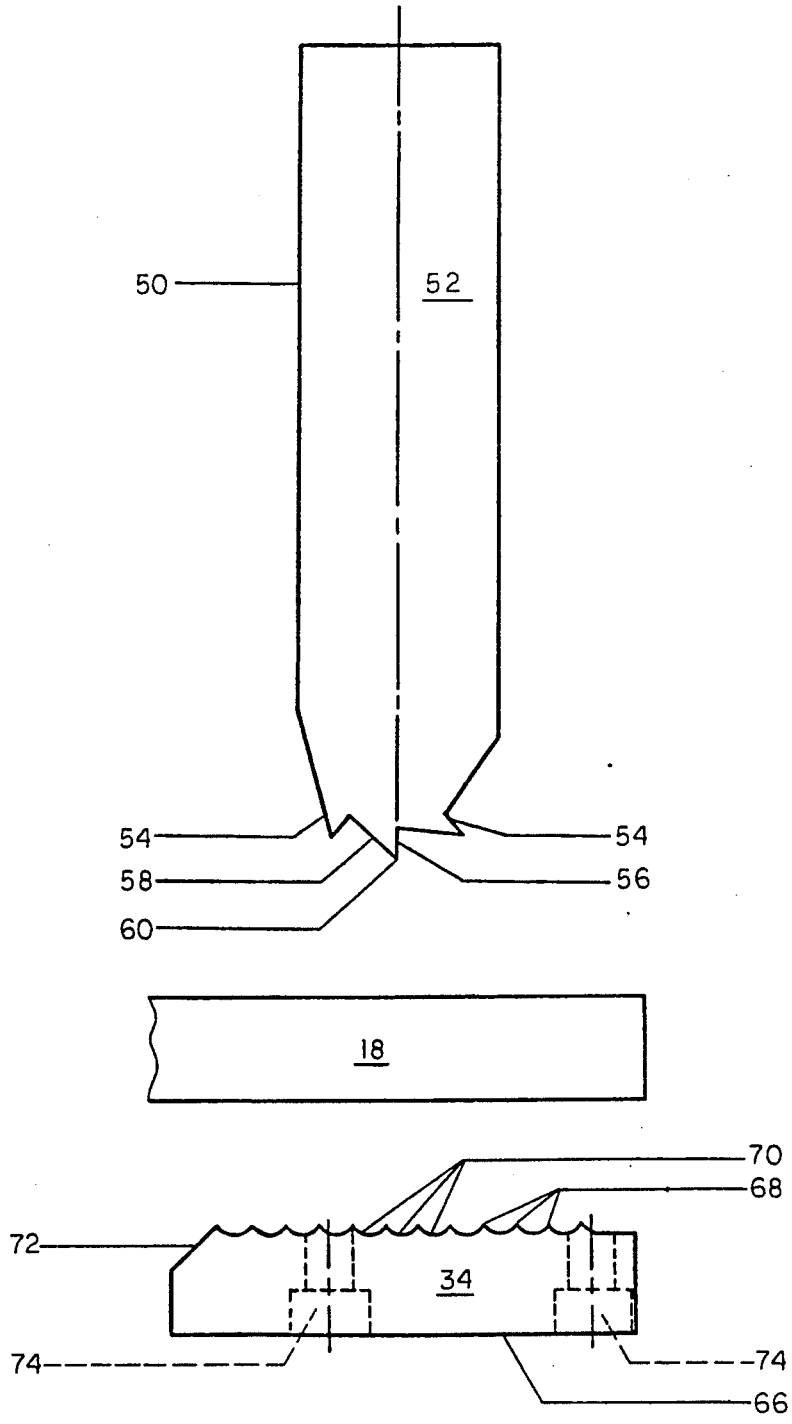
FIG. 5 is a partial exploded elevational view of the upper and lower puller jaws according to the invention and shown in FIG. 4.
Figure 6:
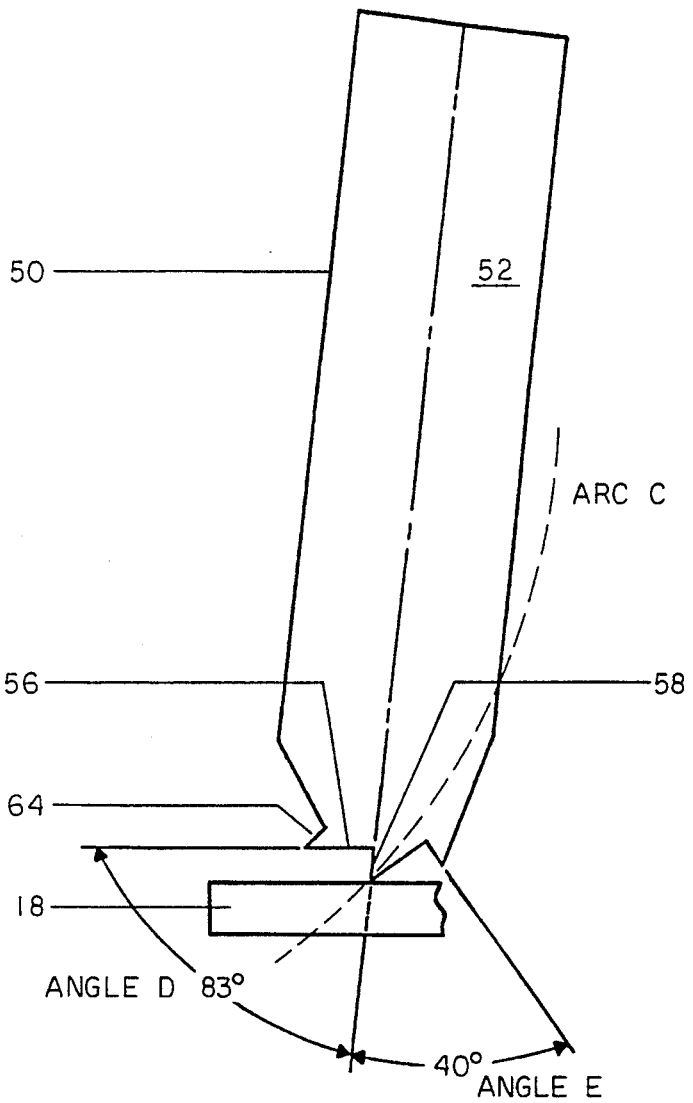
FIG. 6 is a partial enlarged sectional view of the upper puller jaw as seen in FIG. 5.

The upper jaw 32 comprises a plurality of jaw fingers 50, one of which is shown in FIGS. 5 and 6. The fingers 50 may be mounted by suitable means (not shown) in the jaw 32 to move independently of each other or to move together as a single unit. When the fingers 50 move independently, the jaws may grip a wide variety of profiles of the workpieces 18.

The jaw finger 50 comprises a body portion 52, and a plurality of teeth 54 which are machined onto one end of the finger 50. Each tooth 54 comprises a leading edge 56, a trailing edge 58, and a sharp pointed end 60 which is suitable for gripping the extruded workpiece 18. The angle created between the leading edge 56 of a first tooth 62 and a trailing edge 58 of a second tooth 64 is an attack angle D. The angle created between the leading edges 56 of two adjacent teeth 54 is a spacing angle E. As seen in FIG. 6, the attack angle D of the preferred embodiment is 83° and the spacing angle E is 40°. The rotational movement of the upper jaw 32 with respect to the lower jaw 34 causes the teeth 54 of the jaw finger 50 to travel along an arc C during the gripping and releasing movement of the jaws.

The lower jaw 34 comprises a flat plate 66 wherein a plurality of peaks 68 and valleys 70 are milled onto one surface of the plate 66. One corner of the plate 66, a leading edge 72, has been removed to allow for proper guidance of the workpiece 18 onto the peaks and valleys 68, 70 of the lower jaw 34 during the gripping operation of the extruded workpiece 18. As discussed below, suitable mounting holes 74 have been created in the plate 66 for securing the lower jaw 34 to the mounting structure 30.

In operation, the extrusion puller 14 is adjacent the opening of the extrusion press 12 at the beginning of an extrusion cycle. The extrusion press 12 begins to force the extruded workpiece 18 from the press 12. As it exits the die opening (not shown), the workpiece 18 is supported by the upper surface of the lower jaw 34. At this point, the upper jaw 32 begins to pivot downward until the pointed end 60 of a tooth 54 of the jaw finger 50 contacts the workpiece 18. The teeth 54 of the jaw finger 50 travel along arc C and may contact the workpiece 18 anywhere along this arc depending on the profile of the workpiece 18. As further force is applied by the pivot means 46 of the upper jaw 32, the body of a tooth 54 penetrates the workpiece 18. As more and more of the tooth 54 enters the workpiece 18, the gripping strength of the extrusion puller 14 increases. Unlike the Smith design, the entire body of a tooth 54 of the invention can penetrate the workpiece 18 without interference from the trailing edge 58 of a preceding tooth 54. The pivot means 46 of the upper jaw 32 can apply a predetermined amount of force to the upper jaw fingers 50 so that a sufficient gripping pressure is exerted on the workpiece 18 by the jaw fingers 50 and the lower jaw 34.

Unlike the Smith design, the attack angle D of the jaw finger 50 of the invention is great enough such that regardless of the point of contact along the arc C between the teeth 54 and the workpiece 18, the trailing edge 58 of tooth 54 will not interfere with the leading edge 56 of the first tooth's entry into the workpiece 18. For example, if the first tooth 62 begins to pierce the workpiece 18 as a result of the gripping action by the pivot means 46, the trailing edge 58 of the second tooth 64 will not interfere with the first tooth 62's entry into the workpiece until substantially all of the body of the first tooth 62 has penetrated the workpiece. Because there is no interference between the adjacent teeth, 62 and 64, in gripping the workpiece, the upper jaw is able to create a greater gripping strength on the workpiece 18 and allow for increased pulling speed and pressure from the extrusion puller 14 with less force on the upper jaw.

As discussed earlier, the upper surface of the lower jaw 34 comprises a scalloped design of a plurality of peaks 68 and valleys 70. The peaks 68 are milled to a sharp point with semi-circular deep valleys 70 such that increased gripping ability is achieved. In the preferred embodiment each peak 68 is spaced approximately 0.38 inches from the next, although the spacing can be in the range of 0.125 to 0.625. The combination of the tooth design of the jaw fingers 50 and the scalloped peaks 68 and valleys 70 configuration of the lower jaw markedly improves the gripping strength of the extrusion puller 14. Creation of sufficient gripping pressure between the upper jaw 32 and lower jaw 34 is vital in order to avoid slippage of the workpiece 18 within in the jaws. Each time the workpiece 18 slips within the jaws during the extrusion operation, a defect, commonly known as a "mark" appears in the extruded workpiece. It can be easily understood that frequent marks occurring during the extrusion of a workpiece, which is typically several feet in length, can result in an extremely large amount of waste. Tests have shown that the combination of the jaw finger 50 design and the lower jaw 34 scalloped design has resulted in a dramatic decrease in slippage and defects within the extruded workpiece 18.

Figure 7:
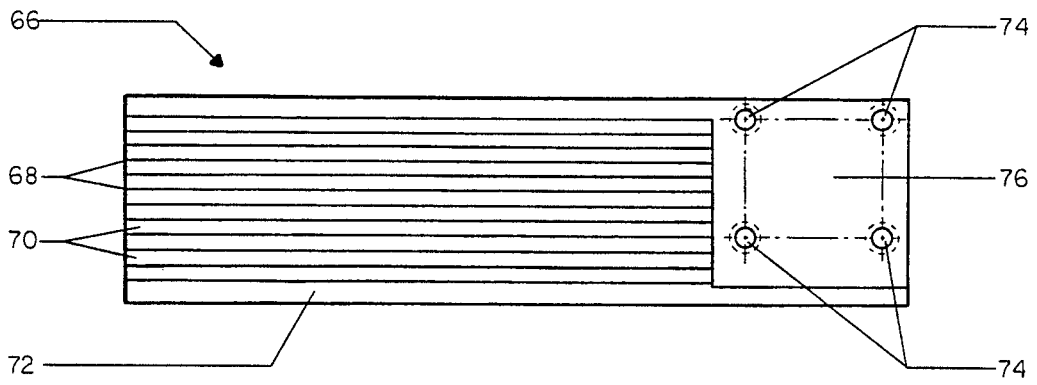
FIG. 7 is a plan view of the lower jaw.

FIG. 7 shows in greater detail the design of the lower jaw 34. As shown in the figure, one end of the flat plate 66 is not machined to include the peaks 68 and valleys 70. This portion of the flat plate 66, the mounting surface 76, is necessary for fixedly attaching the lower jaw 34 to the mounting structure 30. As discussed earlier, the lower jaw 34 has a plurality of mounting holes 74 drilled through the mounting surface 76. Suitable mounting bolts (not shown) are inserted through the mounting holes 76 for fixedly attaching the lower jaw 34 to the mounting structure 30. In practice, it has been discovered that it is more efficient to mount the lower jaw 34 with the mounting surface 76 end of the lower jaw 34 slightly lower than the other end of the lower jaw 34 and not in a horizontal plane. With this configuration, a horizontal plane for the lower jaw 34 is achieved when gripping pressure is applied to the lower jaw 34 by the upper jaw fingers 50. It is most desirable to have a horizontal surface for the lower jaw 34 during the extrusion operation to minimize defects and warpage in the extruded workpiece 18.

While particular embodiments of the invention have been shown, it will be understood, of course, that the invention is not limited thereto since modifications may be made by those skilled in the art, particularly in light of the foregoing teachings. It is, therefore, contemplated by the appended claims to cover any such modification as incorporate those features which constitute the essential features of these improvements within the true spirit and scope of the invention.

We claim:

1. In an extrusion puller having an upper jaw, lower jaw, and mounting means for mounting the upper and lower jaws for reciprocable movement with respect to each other, the upper jaw comprising a plurality of fingers with radially extending gripping teeth circumferentially spaced about a bottom portion thereof for penetrating a workpiece, the lower jaw having a serrated upper face for gripping, and wherein the mounting means for the upper and lower jaws are adapted for reciprocal movement with respect to each other to alternatively grip and release the extruded workpieces, the improvement comprises:

the teeth on the upper jaw fingers having an attack angle and a spacing angle between adjacent teeth selected so that substantially full penetration of at least one of the gripping teeth into the workpiece can be achieved without interference from an adjacent tooth during gripping of a workpiece between the upper and lower jaws.

2. An extrusion puller according to claim 1 wherein each upper jaw finger has at least two teeth.

3. An extrusion puller according to claim 1 wherein the lower jaw serrated upper face has scalloped indentations to increase gripping strength of the lower jaw.

4. An extrusion puller according to claim 1 wherein the upper and lower jaws are mounted for pivotable movement with respect to each other.

5. An extrusion puller according to claim 1 wherein the attack angle is at least 80°.

6. An extrusion puller according to claim 5 wherein the attack angle is about 83°.

7. An extrusion puller according to claim 5 wherein the spacing angle between adjacent teeth is at least 30°.

8. An extrusion puller according to claim 7 wherein the spacing angle between adjacent teeth is about 40°.

9. An extrusion puller according to claim 7 wherein each upper jaw finger has no more than three teeth.

10. An extrusion puller according to claim 9 wherein each upper jaw finger has at least two teeth.

11. An extrusion puller according to claim 10 wherein each upper jaw finger has three teeth.

12. An extrusion puller according to claim 11 wherein the lower jaw serrated upper face has scalloped indentations to increase gripping strength of the lower jaw.

13. An extrusion puller according to claim 12 wherein the spacing between serrations is about 0.38 inches.

14. An extrusion puller according to claim 12 wherein the lower jaw is mounted from one end so that the serrated upper face is cantilevered and at an upper acute angle to the horizontal whereby the serrated surface is forced downwardly toward the horizontal as the upper jaw grips the workpiece therebetween.

15. An extrusion puller according to claim 12 wherein the spacing between serrations is in the range of 0.125 to 0.625 inches.

16. An extrusion puller according to claim 1 wherein the lower jaw is mounted from one end so that the serrated upper face is cantilevered and at an upper acute angle to the horizontal whereby the serrated surface is forced downwardly toward the horizontal as the upper jaw grips the workpiece therebetween.

* * * * *